US006595100B2

(12) United States Patent
Breuer et al.

(10) Patent No.: US 6,595,100 B2
(45) Date of Patent: Jul. 22, 2003

(54) WEAPON

(75) Inventors: Heinz Günter Breuer, Duisburg (DE); Hans Hülsewis, Duisburg (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 10/233,766

(22) Filed: Sep. 4, 2002

(65) Prior Publication Data

US 2003/0051600 A1 Mar. 20, 2003

(30) Foreign Application Priority Data

Sep. 20, 2001 (DE) ..... 101 46 423

(51) Int. Cl.[7] ..... F41A 3/10
(52) U.S. Cl. ..... 89/24; 89/161
(58) Field of Search ..... 89/22, 24, 161; 42/10, 23

(56) References Cited

U.S. PATENT DOCUMENTS 988,791 A * 4/1911 Lehmann
2,434,972 A * 1/1948 Vick
6,006,645 A * 12/1999 Breuer et al. ..... 89/17

FOREIGN PATENT DOCUMENTS

DE 39 14 538 A1 * 11/1990

* cited by examiner

*Primary Examiner*—Stephen M. Johnson
(74) *Attorney, Agent, or Firm*—Venable; Norman N. Kunitz

(57) ABSTRACT

A weapon having a barrel (3) supported in a cradle (2) for axial recoil movement, and having a breech block wedge (7) displaceable, transversely to the barrel axis (6) by a control unit (11) connected to the cradle and acting on a piston rod (8). The control unit (11) includes a spring-loaded shift rod (13) aligned with the piston rod (8), a spring-loaded control rod (15) aligned with a control cam (10) secured to the breech ring (4), and a detent pawl (17) that can be pivoted by a cam (16) from a blocking to a release position. The piston and shift rods (8, 13) are disposed such that during forward motion of the barrel (3), the breech block wedge (7) is already opened by axial displacement of the rods (8, 13) before the control cam (10) displaces the control rod (15).

5 Claims, 5 Drawing Sheets

WEAPON

CROSS-REFERENCE TO RELATED APPLICATION

This application claims the priority of German Patent Application No. DE 101 46 423.1 filed Sep. 20, 2001, which is incorporated herein by reference.

BACKGROUND OF THE INVENTION

The invention relates to a weapon, having a weapon barrel, that is supported displaceably in a cradle from an initial or normal position to a recoil position, and whose breech ring includes a wedge breech block with a breech block wedge that is displaceable, transversely to the bore axis of the weapon barrel from a closed position to an open position In such weapons, after a shot has been fired, it is known to open the breech block wedge automatically, so that the cartridge shell is ejected by an ejector and a new cartridge can then be reloaded. The automatic opening of the breech block wedge is done here via a piston rod, which is axially displaceable on the breech ring from a normal initial position to an actuating position and which in its normal position, on its side facing toward the cradle, protrudes past the end surface of the breech ring and on its side remote from the cradle acts via intermediate members on an opener lever connected to the breech block wedge, such that a displacement of the piston rod toward the breech block wedge leads to a pivoting motion of the opener lever and thus to an opening of the breech block wedge. Therefore, if after a shot has been fired, upon a forward motion of the weapon barrel from its recoil position to its initial normal position, the piston rod is displaced into its actuating position via a control unit disposed on the cradle, then the breech block wedge is moved to its open position and is kept in this position by the ejector. After that, a new cartridge can be loaded, and the breech block can be displaced into its closed position. In these known weapons, it is disadvantageous that the control units, flanged to or mounted on the barrel cradle in order to guide the piston rod, require a relatively large amount of space and are high in weight.

SUMMARY OF THE INVENTION

The object of the invention is to provide a method of the type defined at the outset, with a control unit of compact structure, which by an optimal introduction of force has a lower weight and smaller structural volume than known control units.

This object generally is attained according to the present invention, as discussed below. A number of particularly advantageous features of the invention are disclosed.

The invention is based essentially on the concept of disposing a control unit on the cradle, which includes not only a shift rod, which is displaceable axially toward the muzzle of the weapon barrel counter to the pressure of a first spring and is aligned with the piston rod, but also a control rod, which is displaceable axially toward the muzzle of the weapon barrel counter to the pressure of a second spring and is aligned with the control cam, as well as a detent pawl, which can be pivoted by a cam from a blocking position to a release position. The cam engages a recess in the control rod such that in the initial or normal position of the control rod, the cam presses the detent pawl into a detent groove of the shift rod, so that the shift rod is not axially displaceable, and so that by displacement of the control rod in the direction of the muzzle of the weapon barrel, the cam pivots the detent pawl into its release position and thus out of the detent groove. The lengths of the piston rod and of the shift rod are selected such that the breech block wedge, upon the forward motion of the weapon barrel as a result of the axial displacement of these rods, has already been displaced into its open position before the control cam causes a displacement of the control rod and thus a pivoting of the detent pawl into its release position.

The weapon of the invention has the advantage over known weapons that at the moment the breech block wedge opens, only thrust forces but no torques whatever are exerted via the transmission elements onto the barrel cradle.

In a first embodiment of the invention, the control unit includes a housing that is secured to the cradle, and inside of which the detent pawl, parts of the shift rod, the control rod and the springs are located. The ends of the shift rod and control rod acting, respectively, on the piston rod and the control cam protrude laterally out of the housing of the control unit.

To make it possible to open the breech block wedge manually, as well as after a shot has been fired, according to a further embodiment of the invention, a manually pivotable shift lever, connected to the detent pawl, is disposed on the outside of the housing of the control unit. If the detent pawl is pivoted into the release position by this shift lever, then automatic opening of the breech block wedge upon a forward motion of the weapon barrel does not occur.

It has finally proved especially advantageous to secure the control unit to the end of the cradle near the breech ring, in order to make the shift rod and control rod as short as possible.

Further details and advantages of the invention will become apparent from the ensuing exemplary embodiments explained in conjunction with the drawings.

DESCRIPTION OF THE PREFERRED EMBODIMENTS

Figure 1:
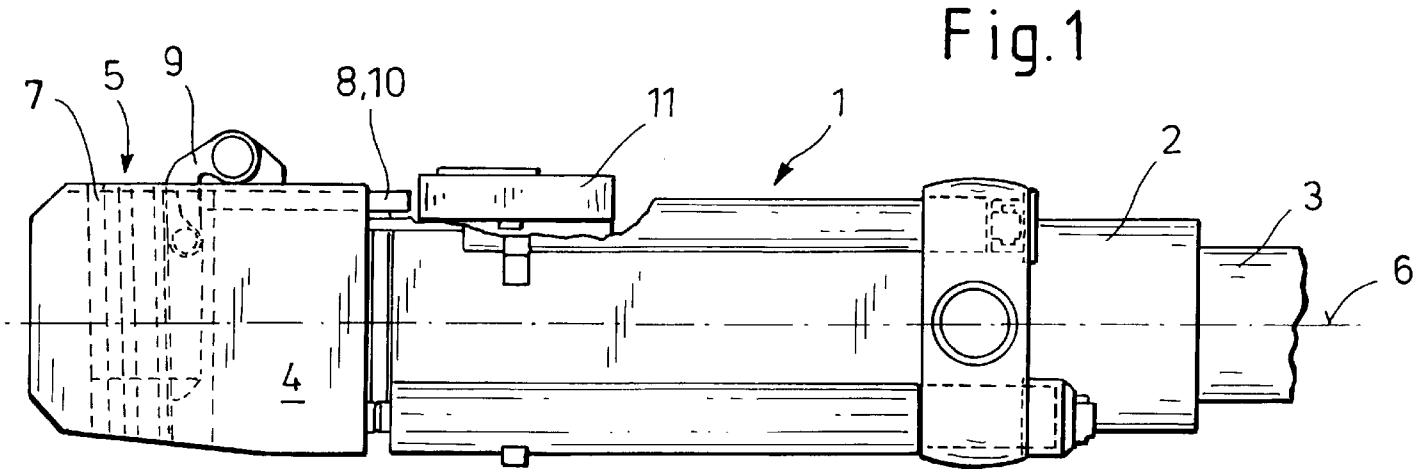
FIG. 1 is a side view of the breech block region of a barrel-type weapon according to the invention, in the firing position, with reciprocating wedge breech block, barrel cradle and control unit.
Figure 3:
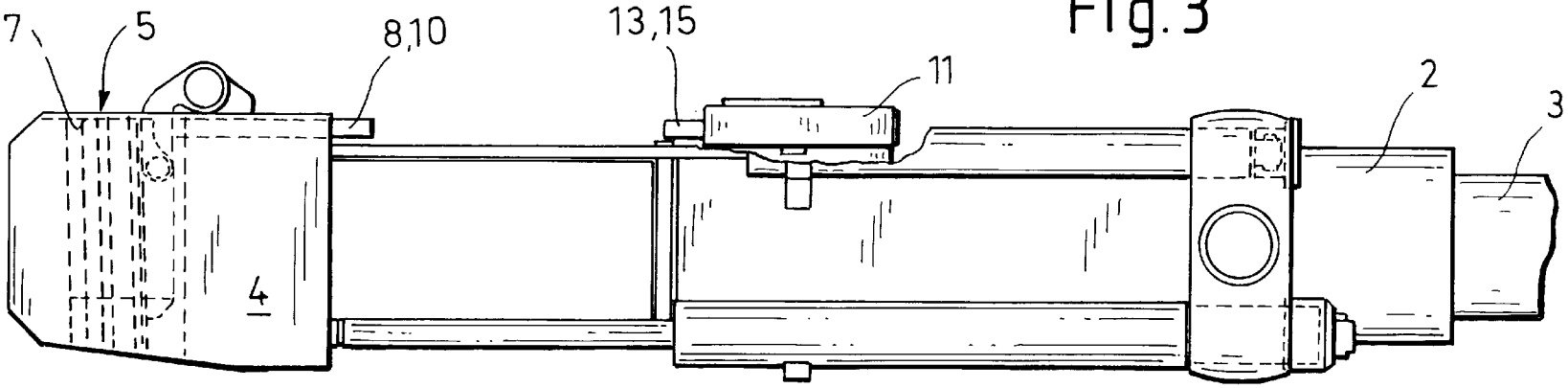
FIG. 3 is a side view of the barrel-type weapon shown in FIG. 1, in the maximal return of recoil position of the weapon barrel with the breech block closed.

In FIG. 1, reference numeral 1 indicates the breech block region of a weapon of the invention, having a weapon barrel 3 supported displaceably in a barrel cradle 2 from an initial or normal position, shown in FIG. 1, to a recoil position (see FIG. 3). A breech ring 4 with a reciprocating wedge breech block 5 is connected to the tail end of the weapon barrel 3. The reciprocating wedge breech block 5 includes a breech block wedge 7 that can be displaced transversely to the bore or longitudinal axis 6 of the weapon barrel 3 from a closed to an open position.

Disposed on the breech ring 4 is a piston rod 8, which is axially displaceable from an initial or normal position, as shown, to an actuating position, and which in its initial normal position has its end facing toward the barrel cradle 2 protruding past the breech ring 4. The end of the piston rod 8, that is remote from the barrel cradle 2 acts, via intermediate members, not shown, on an opener lever 9 connected to the breech block wedge 7 such that a displacement of the piston rod 8 toward the breech block wedge 7 leads to a pivoting motion of the opener lever 9 and thus to an opening of the breech block wedge 7. A control cam 10 (FIG. 2) is also mounted solidly on the breech ring 4 at its forward end and extends parallel to the piston rod 8.

Figure 9:
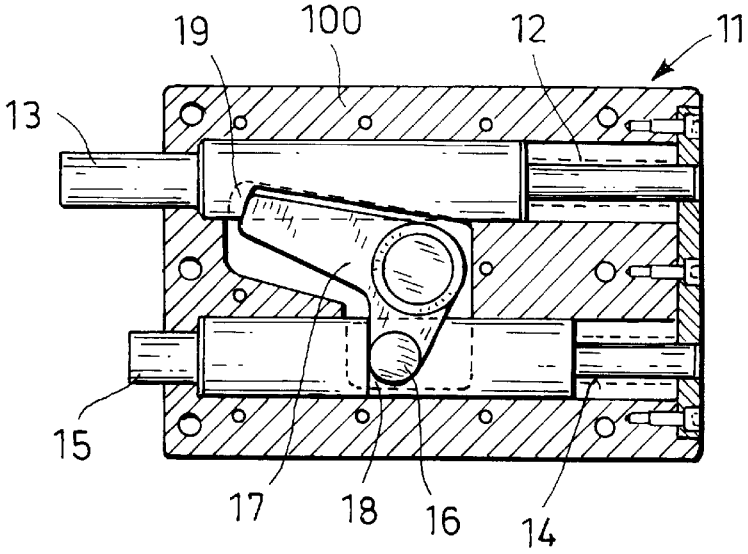
FIG. 9 is an enlarged sectional view of the control unit shown in FIGS. 1–8.
Figure 10:
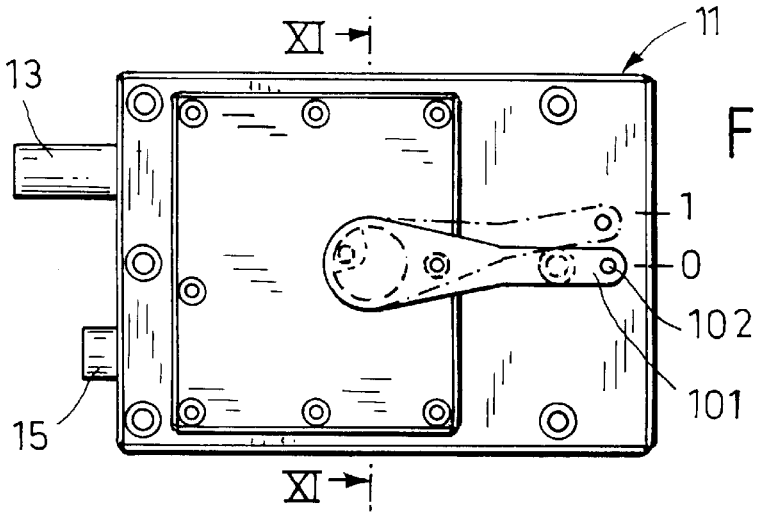
FIG. 10 is a plan view of the control unit shown in FIG. 9.
Figure 11:
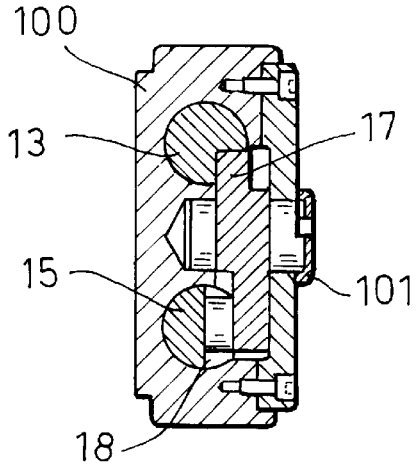
FIG. 11 is a cross-section through the control unit, taken along the line marked XI—XI in FIG. 10.

The piston rod 8 and the control cam 10 are operatively connected via a control unit 11 disposed on the surface of the barrel cradle 2. The structure of the control unit 11 is shown in FIGS. 9–11, and its function will be described in further detail hereinafter.

The control unit 11 has a housing 100 that is solidly connected to the barrel cradle 2, for instance, via a flange connection. The control unit 11 includes a shift rod 13 that is displaceable axially toward the muzzle of the weapon barrel 3 counter to the pressure of a first spring 12 and is aligned with the piston rod 8, and a control rod 15 that is displaceable axially toward the muzzle of the weapon barrel 3 counter to the pressure of a second spring 14 and is aligned with the control cam 10. The control unit 11 further includes a detent pawl 17 that is pivotable by a cam 16 from a blocking position (as shown in FIG. 9) into a release position.

A shift lever 101 (FIG. 10) connected to the detent pawl 17 is disposed on the outside of the housing 100 of the control unit 11 and is pivotable manually from a position marked "0" to a position marked "1". The shift lever 101 can be positioned in the positions "0" and "1" by a thrust piece 102 on the housing 100.

In the "0" position of the shift lever 101, the cam 16 engages a recess 18 in the control rod 15, such that in the initial normal positions of the control rod and shift rod 15 and 13, respectively, the cam 16 presses the detent pawl 17 into a detent groove 19 of the shift rod 13 so that the shift rod 13 is not axially displaceable, and such that by displacement of the control rod 15 in the direction of the muzzle of the weapon barrel 3, the cam 16 pivots the detent pawl 17 into its release position and thus out of the detent groove 19.

In the "1" position of the shift lever 101, the detent pawl 17 is pivoted into its release position, so that the shift rod 13 is constantly unblocked.

The mode of operation of the weapon of the invention will now be described. Let it be assumed that the shift lever is in the position marked "0" (FIG. 10), and that the weapon is initially in the firing position shown in FIGS. 1 and 2, in which the breech block wedge 7 is closed. The control cam 10 has displaced the control rod 15 toward the muzzle of the weapon barrel 3, counter to the pressure of the second spring 14, so that the detent pawl 17 unblocks, and the maximally extended piston rod 8 has displaced the shift rod 13 maximally toward the muzzle of the weapon barrel 3, counter to the pressure of the first spring 12.

Figure 4:
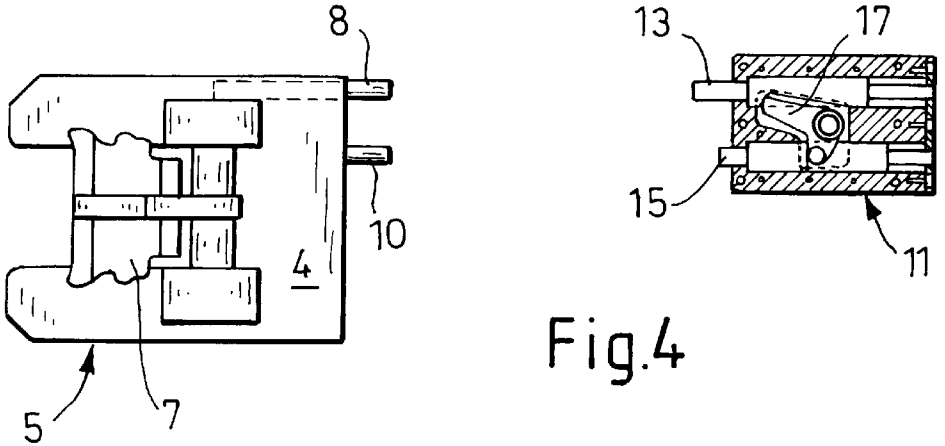
FIG. 4 is a plan view of only the breech block and the control unit (in section) of the barrel-type weapon shown in FIG. 3.

After a shot is fired, the recoil of the weapon barrel 3 to the recoil position, shown in FIGS. 3 and 4, takes place. The breech block wedge 7 remains closed, and the piston rod 8 remains in its maximally extended position. The two springs 12, 14 press the shift rod 13 and the control rod 15 into their normal positions, and the detent pawl 17 is pressed by the control rod 15, via the cam 16, into the detent groove 19 of the shift rod 13, thus blocking the shift rod (FIG. 9).

Figure 5:
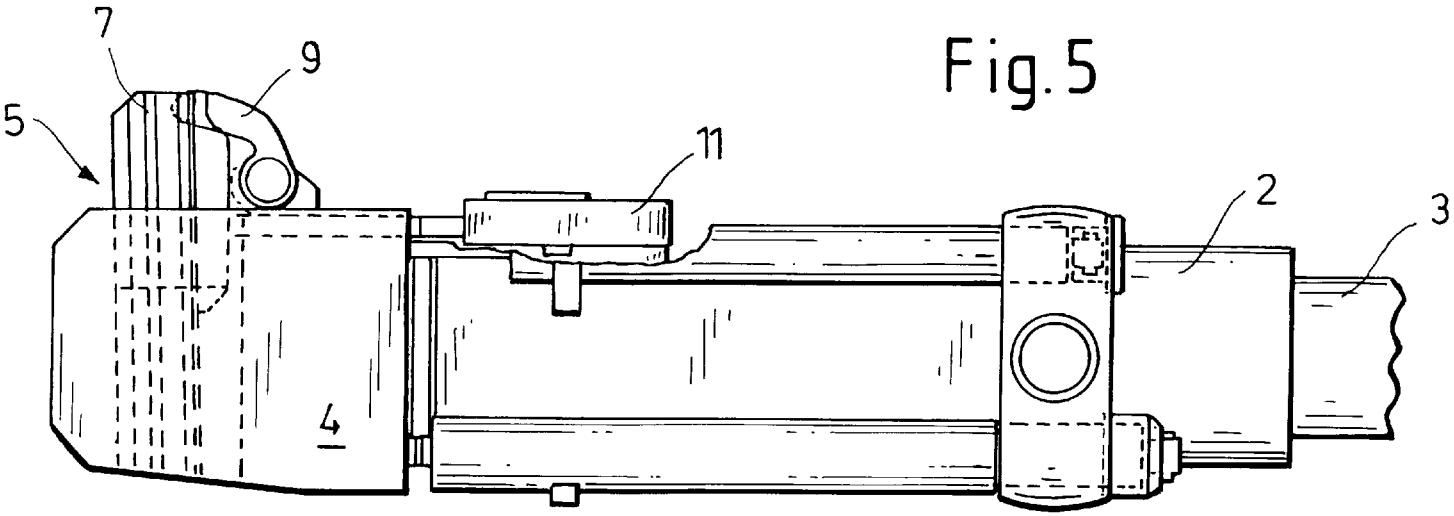
FIG. 5 is a side view of the barrel-type weapon shown in FIG. 1 with the breech block wedge open.
Figure 6:
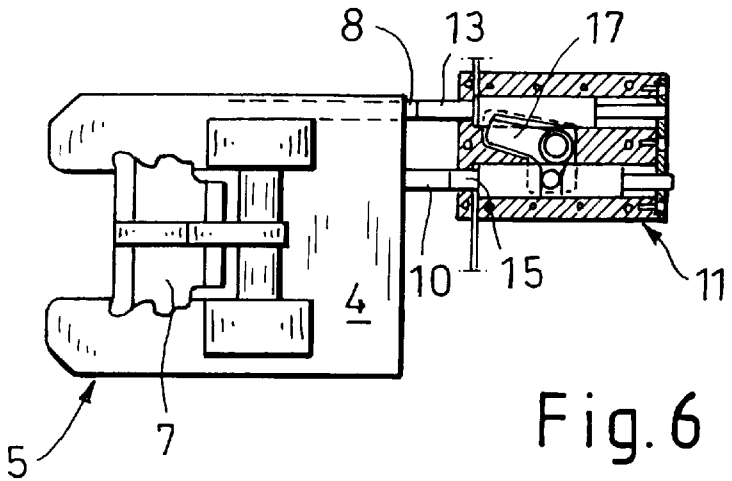
FIG. 6 is a plan view of only the breech block and the control unit (in section) of the barrel-type weapon shown in FIG. 5.

Once the maximum recoil position is reached, the weapon barrel 3 is displaced back toward the barrel cradle 2 by a barrel recuperator. The maximally extended piston rod 8 strikes the shift rod 13 in the process, the shift rod 13 being in its initial position and blocked, so that the piston rod 8 is displaced toward the opener lever 9 before the control cam 10 brings about a displacement of the control rod 15. By means of the pivoting opener lever 9, the breech block wedge 7 is displaced into its open position (with an overstroke) and the cartridge shell of the fired cartridge is ejected (FIGS. 5 and 6).

Figure 7:
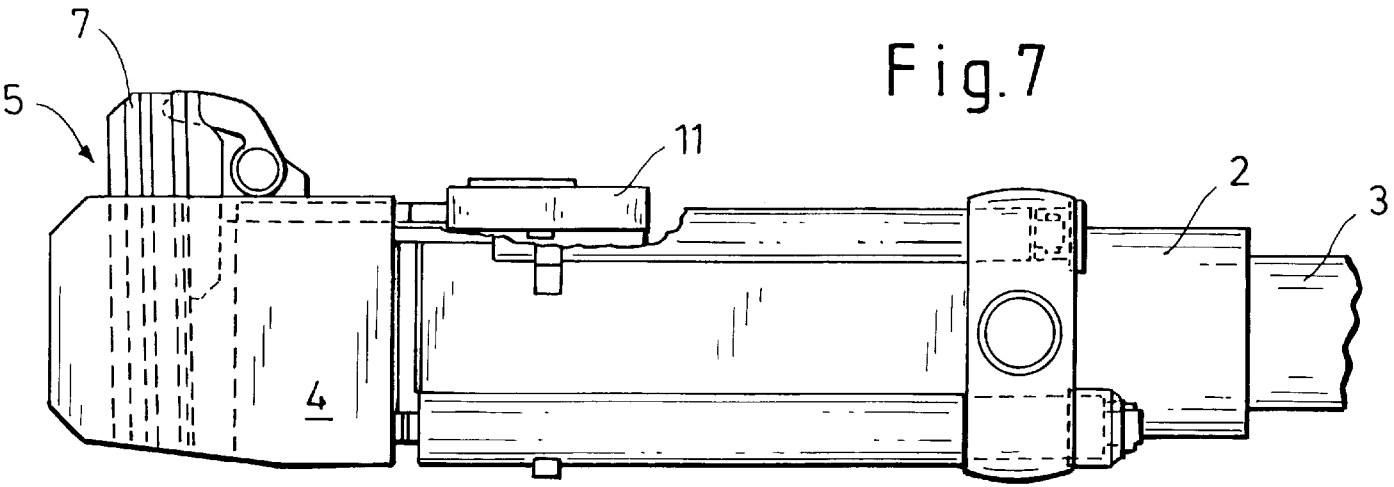
FIG. 7 is a side view of the barrel-type weapon shown in FIG. 1, with the breech block wedge open and in the loading position.
Figure 8:
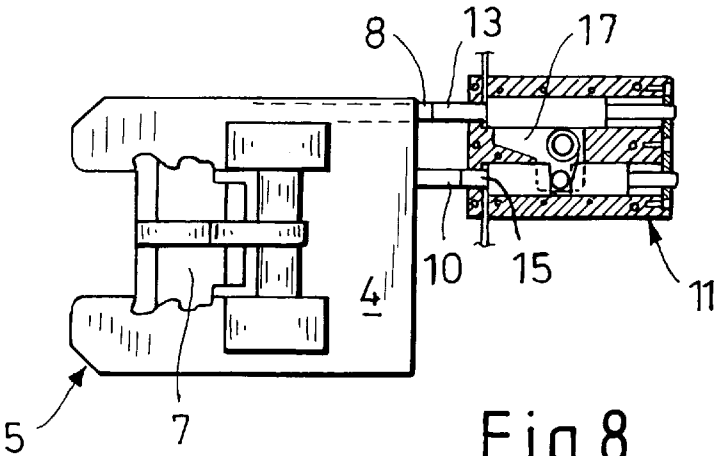
FIG. 8 is a plan view of only the breech block and the control unit (in section) of the barrel-type weapon shown in FIG. 7.

Next, the control cam 10 reaches the control rod 15 and displaces it counter to the pressure of the second spring 14, so that the detent pawl 17 is pivoted into the release position, and the shift rod 13 is unblocked. The breech block wedge 7 drops back somewhat and is now kept in its loading position (FIGS. 7 and 8) by ejectors (not shown) disposed on the breech block side.

Figure 2:
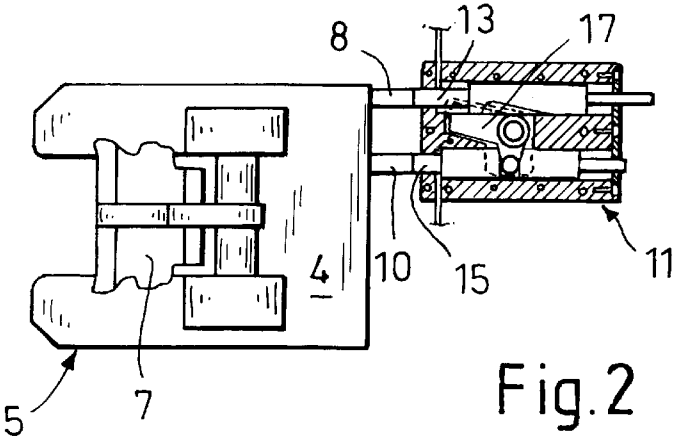
FIG. 2 is a plan view of only the breech block and the control unit (in section) of the barrel-type weapon shown in FIG. 1.

The weapon can now be loaded. The ejectors, not shown, are pivoted upon insertion of the cartridge into the loading chamber of the weapon and release the breech block wedge 7, so that the breech block wedge is displaced into its closed position. The weapon is now again ready for firing (FIGS. 1 and 2).

As soon as the shift lever 101 is in the position marked "1" (FIG. 10), the shift rod 13 is constantly unblocked. In this case, the breech block wedge 7 is not automatically opened upon the forward motion of the weapon barrel 3, because when the piston rod 8 strikes the shift rod 13, the shift rod is displaced by the piston rod 8 toward the muzzle of the weapon barrel. The wedge breech block 5 remains closed in this case and must be opened manually.

The invention now being fully described, it will be apparent to one of ordinary skill in the art that many changes and modifications can be made thereto without departing from the spirit or scope of the invention as set forth herein.

What is claimed is:

1. A weapon comprising:

a weapon barrel supported in a cradle for displacement from a normal position to a recoil position, and having a breech ring that includes a wedge breech block with a breech block wedge that is displaceable transversely to the bore axis of the weapon barrel from a closed position to an open position;

a piston rod, which is axially displaceable from a normal position to an actuation position, disposed on the breech ring and having its end facing the cradle protruding past an end of the breech ring, and having its end remote from the cradle acting via intermediate members on an opener lever connected to the breech block wedge such that a displacement of the piston rod toward the breech block wedge causes a pivoting motion of the opener level, and thus an opening of the breech block wedge;

a control cam fixedly mounted on the breech ring and extending substantially parallel to the piston rod;

a control unit mounted on the cradle and operatively connecting the piston rod and the control cam such that, upon a forward motion of the weapon barrel from its recoil position to its normal position, the piston rod is displaced by the control unit, and thus the breech block wedge is also displaced into its open position;

the control unit includes a shift rod, which is displaceable axially toward the muzzle of the weapon barrel counter to the pressure of a first spring and is axially aligned with the piston rod, a control rod, which is displaceable axially toward the muzzle of the weapon barrel counter to the pressure of a second spring and is axially aligned with the control cam, and a detent pawl, which is pivotable by a cam from a blocking position to a release position, wherein the cam engages a recess in the control rod such that in the normal position of the control rod, the cam presses the detent pawl into a detent groove of the shift rod so as to prevent axial displacement of the shift rod, and such that upon displacement of the control rod in the direction of the muzzle of the weapon barrel, the cam pivots the detent pawl into its release position and thus out of the detent groove; and the lengths of the piston rod and of the shift rod are such that the breech block wedge, upon the forward motion of the weapon barrel as a result of the axial displacement of the piston and shift rods has already been displaced into its open position before the control cam causes a displacement of the control rod, and thus a pivoting of the detent pawl into its release position.

2. The weapon of claim 1, wherein: the control unit includes a housing that is secured to the cradle and inside of which housing the detent pawl, parts of the shift rod and the control rod, and the springs are located; and the ends of the shift rod and of the control rod acting on the piston rod and the control cam, respectively, protrude beyond an end of the housing facing toward the breech ring.

3. The weapon of claim 2, further including a manually pivotable shift lever disposed on the outside of the housing of the control unit, with said shift lever being connected to the detent pawl so that the detent pawl can be pivoted from its blocking position to its release position by pivoting the shift lever.

4. The weapon according to claim 1, wherein the control unit is secured to the cradle at an end and adjacent to the breech ring.

5. The weapon according to claim 2, wherein the control unit housing is secured to the cradle at an end and adjacent to the breech ring.

* * * * *